US005557815A

United States Patent [19]

Mintz et al.

[11] Patent Number: 5,557,815

[45] Date of Patent: Sep. 24, 1996

[54] CONVERTIBLE PILLOW/CHAIR PAD

[75] Inventors: Jacob Mintz, Fall River; Cidalisa Andrade, Swansea, both of Mass.

[73] Assignee: Klear-Vu Corp., Fall River, Mass.

[21] Appl. No.: 419,191

[22] Filed: Apr. 10, 1995

[51] Int. Cl.[6] ..... A47G 9/00; A47C 27/00

[52] U.S. Cl. ..... 5/636; 5/490; 5/653; 297/223; 297/283.1

[58] Field of Search ..... 5/490, 636, 472, 5/653, 654; 297/223, 283.1

[56] References Cited

U.S. PATENT DOCUMENTS

| | | | |
|---|---|---|---|
| 1,469,523 | 10/1923 | McGarvey | 5/490 |
| 1,974,723 | 9/1934 | Richig | 5/653 |
| 3,109,474 | 11/1963 | Levi | 5/490 |
| 4,312,087 | 1/1982 | De Geus | 5/490 |
| 4,563,785 | 1/1986 | Samelson | 5/472 |

FOREIGN PATENT DOCUMENTS

| | | | |
|---|---|---|---|
| 16809 | of 1907 | United Kingdom | 5/490 |

*Primary Examiner*—Alexander Grosz

*Attorney, Agent, or Firm*—Robert L. Epstein; Harold James; James & Franklin

[57] ABSTRACT

The edges of first and second fabric sides are joined along a seam to form an enclosure for cushion material. Tie strings extend from the seam along one end of the cushion. First and second fabric flaps are provided. Each flap is joined along three edges to the seam. One flap extends from the same end of the cushion as the tie strings. The other flap extends from the opposite end of the cushion. When located on the same side of the cushion, the flaps partially overlap and hide the underlying side from view. Reversing the positions of the flaps hides the tie strings and the other side of the cushion, converting the chair pad into a decorative pillow. If the sides have different appearances, and if the surfaces of each flap coordinate in appearance with different ones of the sides respectively, the appearance of the cushion can be changed as well, as the cushion is converted.

15 Claims, 5 Drawing Sheets

CONVERTIBLE PILLOW/CHAIR PAD

The present invention relates to cushions and more particularly to a cushion which can be converted for use either as a decorative pillow, for example, to adorn a couch or bed, or as a pad for a chair seat.

In situations where a very small living space or carrying capacity is involved, it may be necessary to limit the number of cushions present as much as possible. This is because cushions tend to be bulky and thus take up considerable room. They are difficult to carry and store.

The present invention overcomes this problem by providing a single cushion which is easily convertible to function either as a decorative or "throw" pillow or as a chair seat pad. Moreover, the appearance of the cushion can be changed as the conversion takes place. Thus, when in the pillow mode, the cushion may have one color, pattern etc. and when converted to a chair pad, a completely different color, pattern etc.

The invention thus saves space but providing two types of cushion in one. Moreover, it can be sold at a cost comparable to cushions capable of performing only one of the functions and thus saves money as well.

A chair seat pad is provided with a means to anchor it to a chair as it rests on the seat, such that the pad maintains the desired position. One simple and commonly used method to accomplish this is to employ pairs of tie strings which extend from the seam of the pad. These strings are adapted to be tied around vertical elements of the chair back to secure the pad.

Decorative or throw pillows, on the other hand, do not require tie strings as they are not intended to be anchored. Having such strings would be considered unsightly and substantially detract from the decorative nature of such pillows. Accordingly, it has been heretofore necessary to have separate decorative pillows without tie strings and chair seat pads with tie strings, in order to achieve both functions acceptably.

In copending application Ser. No. 08/305,593 now U.S. Pat. No. 5,475,886 filed Sep. 14, 1994 and entitled "Combination Pillow and Chair Cushion", a structure is disclosed to permit a cushion to be converted by incorporating an elastic compartment or pocket along the rear of the cushion, proximate the seam from which tie strings extend. The compartment serves to enclose and retain the tie strings when they are not in use. The exterior of the compartment is similar in appearance to the remainder of the exterior of the cushion, so the presence of the compartment does not change the appearance of the cushion. With this simple structure, the cushion is capable of dual function, either as a decorative pillow with the tie strings hidden or as a chair seat cushion with the tie strings exposed.

The present invention provides a more sophisticated structure. A similar result is achieved in that a single cushion can perform both functions, however, more versatility is obtained because the present invention may result in a change in appearance as convertibility takes place, as well.

It is therefore, a prime object of the present invention to provide a convertible pillow/chair pad.

It is another object of the present invention to provide a convertible pillow/chair pad which changes appearance as well as function.

It is another object of the present invention to provide a cushion which is convertible between pillow and a chair pad by simply changing the position of flaps.

It is another object of the present invention to provide a convertible pillow/chair paid which is simple to construct and to use.

BRIEF SUMMARY OF THE INVENTION

In accordance with one aspect of the present invention, a convertible cushion is formed of first and second sides having edges joined along a seam to form an enclosure. A flap of flexible material having four edges extends from one end of the enclosure. The flap is joined to the enclosure seam along three of its edges. Tie strings are provided. The tie strings extend from the seam along same end of the enclosure as the flap.

The cushion may include a second flap extending from the opposite end of the enclosure. Like the first flap, the second flap is joined to the enclosure seam along three of its edges.

The flaps partially overlap when situated adjacent the same side of the enclosure to hide the underlying side from view. Each flap is shorter than the sheets which form the sides of the enclosure.

The first and second sheets may have different appearances. Each flap has one surface with the same appearance as the first sheet and a second surface with the same appearance as the second sheet.

A ruffle may be provided. The ruffle may extend from the enclosure seam.

In accordance with another aspect of the present invention, a convertible cushion is formed of first and second sides joined along a seam to form an enclosure for cushion material. First and second flaps are provided, each extending from the seam of a different enclosure end. Each has a first and a second surface. Each surface coordinates in appearance with a different one of the enclosure sides. Each of the flaps is affixed to the enclosure seam along three edges. The flaps partially overlap when adjacent the same side of the enclosure.

To these and to such other objects which may hereinafter appear, the present invention relates to a convertible pillow/chair pad, as set forth in detail in the following specification, recited in the annexed claims and illustrated in the accompanying drawings wherein like numerals refer to like parts and in which:

DETAILED DESCRIPTION

The cushion is composed of a first flexible fabric side 10 and a second flexible fabric side 12. Sides 10 and 12 are joined along a seam 14 to form an enclosure for cushion material 16.

Figure 1:
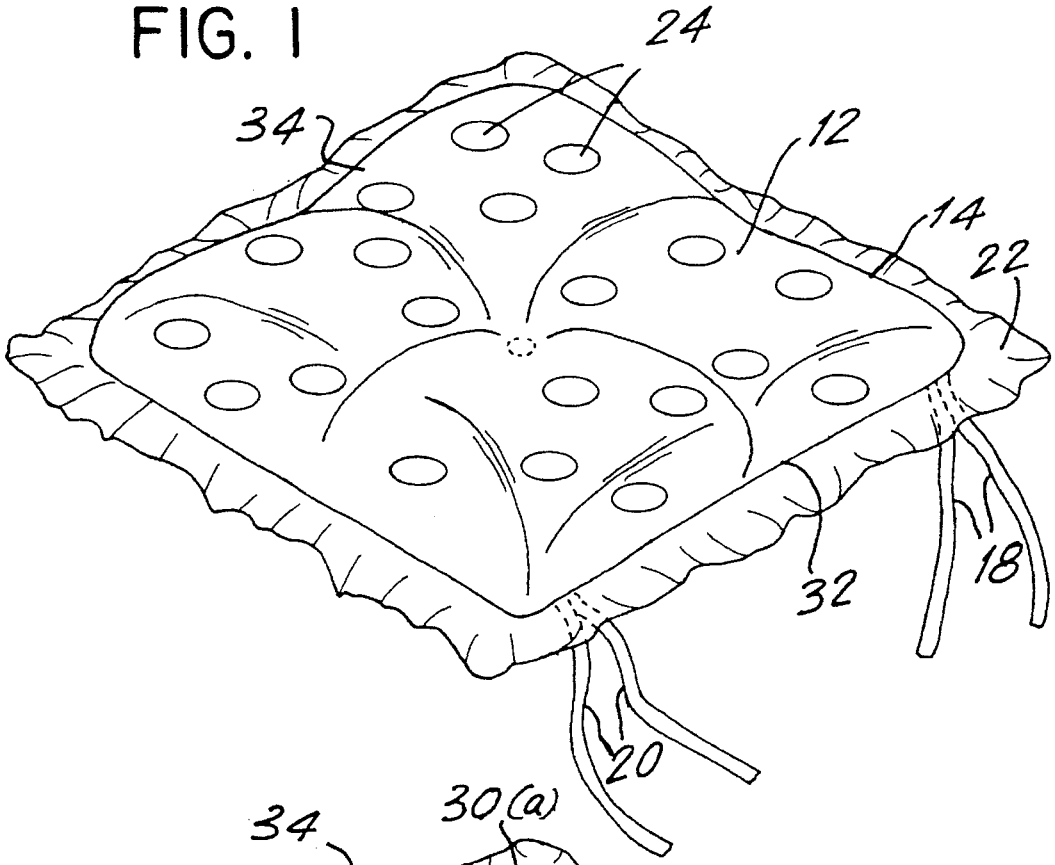
FIG. 1 is an isometric view showing one side of the invention in the chair pad mode.
Figure 2:
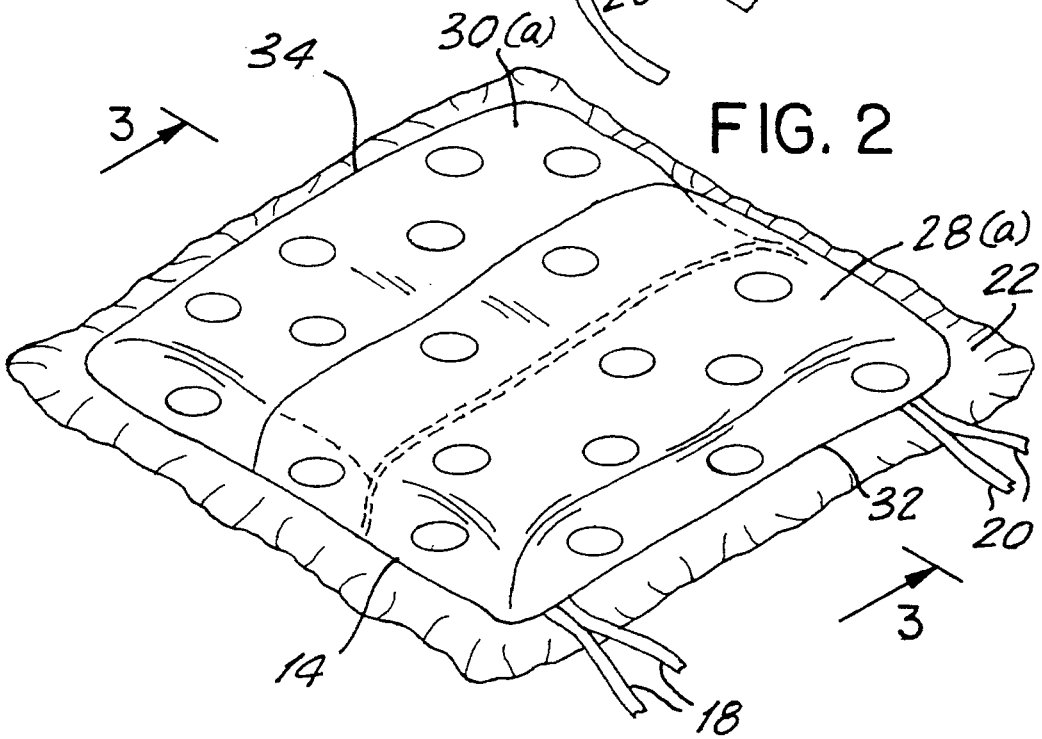
FIG. 2 is an isometric view showing the other side of the invention in the chair pad mode.

As seen in FIGS. 1 and 2, where the cushion is shown in the chair pad mode, means are provided for anchoring the cushion to a chair, preferrably in the form of tie string pairs 18, 20 which extend from seam 14 along rear end 20 of the enclosure. Although tie strings are commonly employed for this purpose, any instrumentality which may be used to encircle a vertical element of a chair may be substituted for the tie strings. Thus, strings which snap together or use a hook and loop ribbon to close may be utilized. An optional ruffle 22 may extend from seam 14, if desired.

Side 10 of the enclosure may have a distinctive appearance. For example, a particular color, pattern or texture may be provided by conventional methods. In the drawings, this distinctive appearance is illustrated with a pattern of circles 24. Moreover, the cushion may be given a tufted appearance through the use of a real or simulated button 26. If a simulated button is used, it may be formed by sewing the middle portion of sides 10 and 12 together in a circular pattern.

Figure 3:
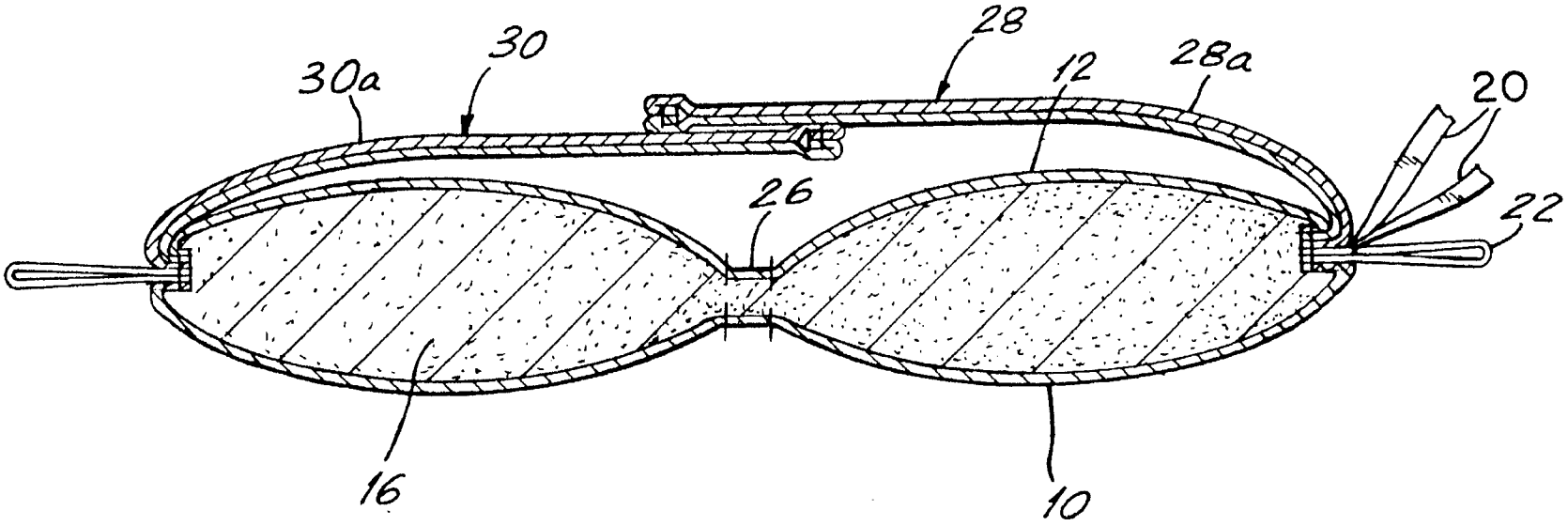
FIG. 3 is a cross sectional view of the cushion of FIG. 1 taken along line 3—3 of FIG. 2.

As seen in FIG. 2 and 3, in the chair pad mode, side 12 is not visable, being hidden beneath a pair of oppositely extending, partially overlapping fabric flaps 28, 30. Each flap is joined to seam 14 along three edges, with the fourth edge being unattached. Flap 28 extends from the same end 32 of the enclosure as tie strings 18, 20. Flap 30 extends from the opposite end 34 of the enclosure. Flaps 28, 30 are each longer than half but shorter than the entire width of the sides such they overlap when adjacent the same side of the enclosure, thus completely hiding the underlying side.

Each flap 28, 30 has a first surface 28*a*, 30*a* which has an appearance coordinated with the appearance of side 10. The other surface 28*b*, 30*b* of each flap is coordinated in appearance with the other side 12, which is illustrated in the drawings as unornamented. Each flap can be formed of two pieces of material (FIG. 3) or a single sheet of material (FIG. 4, 5).

Figure 4:
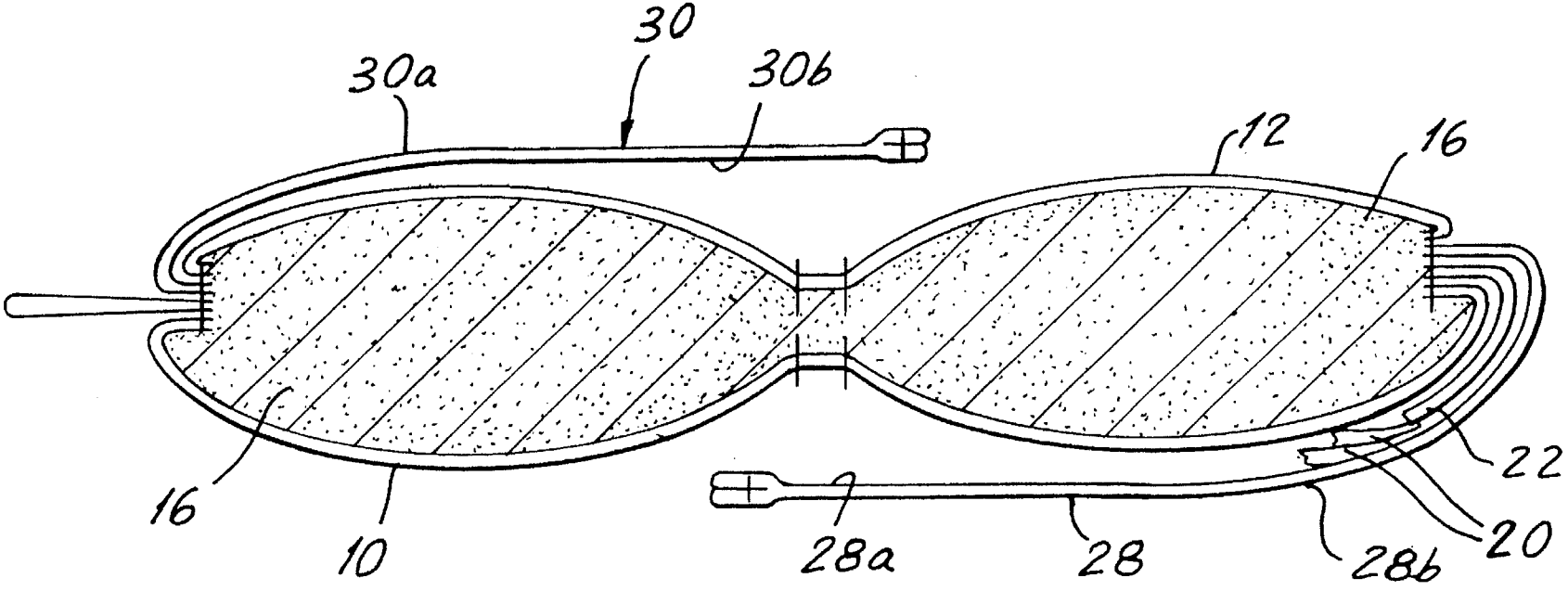
FIG. 4 is a cross sectional view of the cushion in transition between modes.
Figure 5:
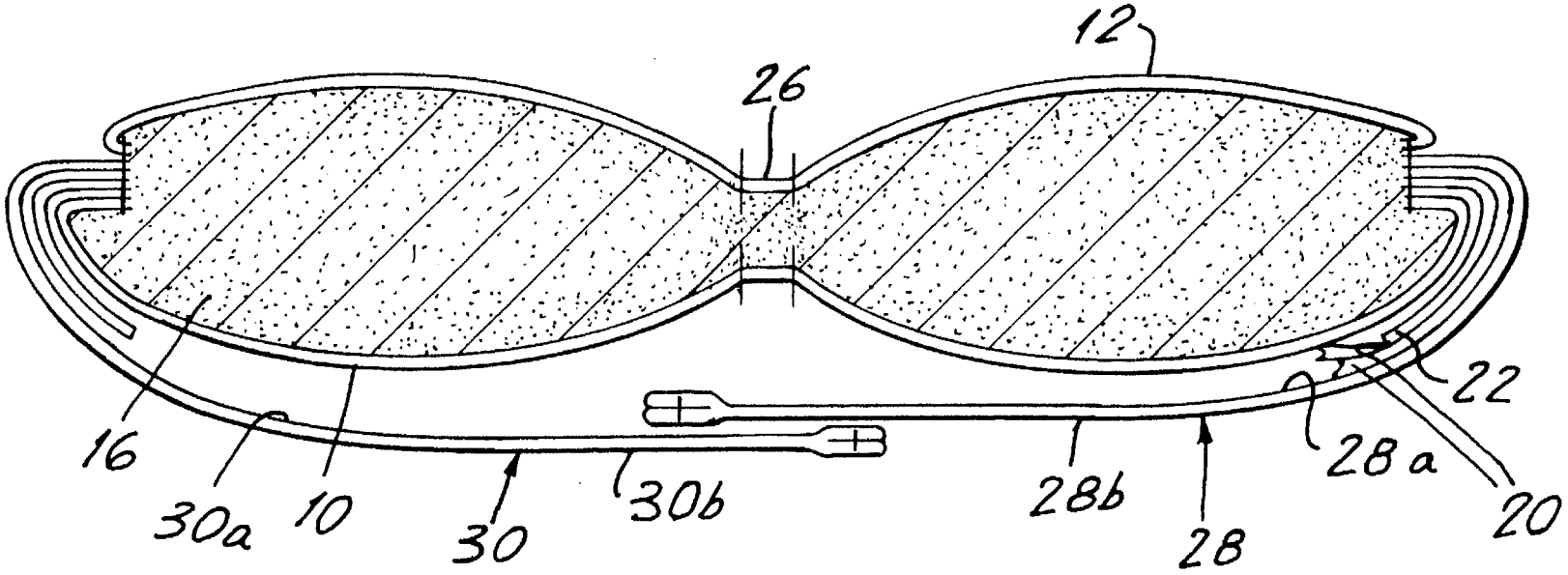
FIG. 5 is a cross sectional view of the cushion of FIG. 1 in the pillow mode.
Figure 6:
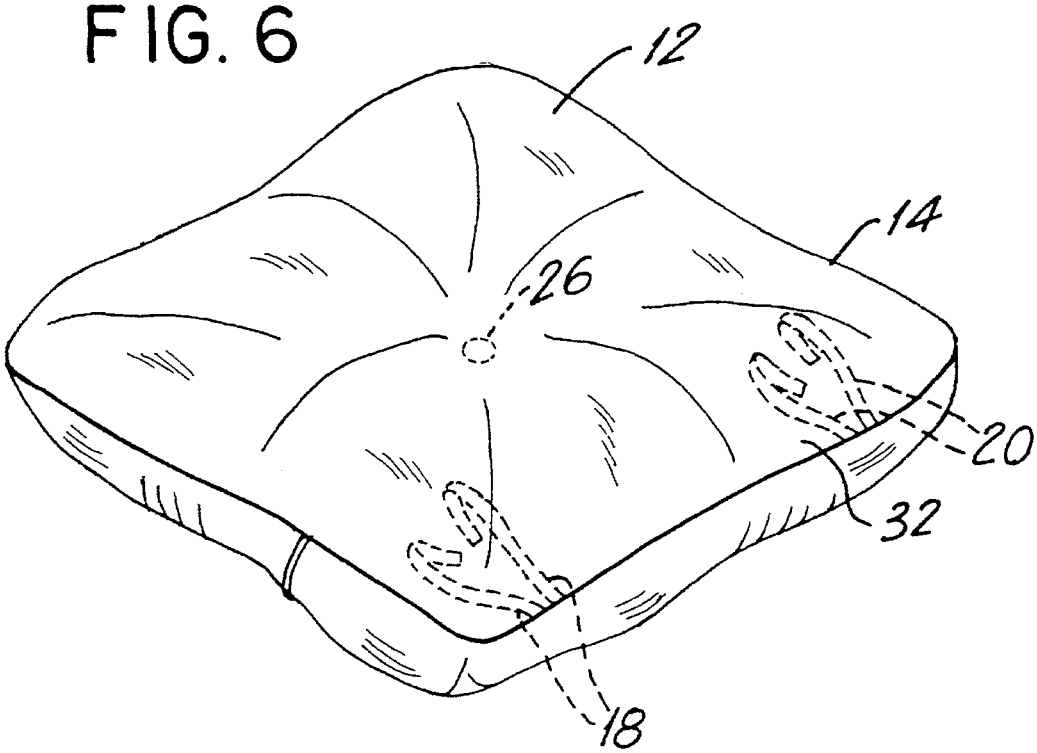
FIG. 6 is an isometric view of one side of the cushion in the pillow mode.
Figure 7:
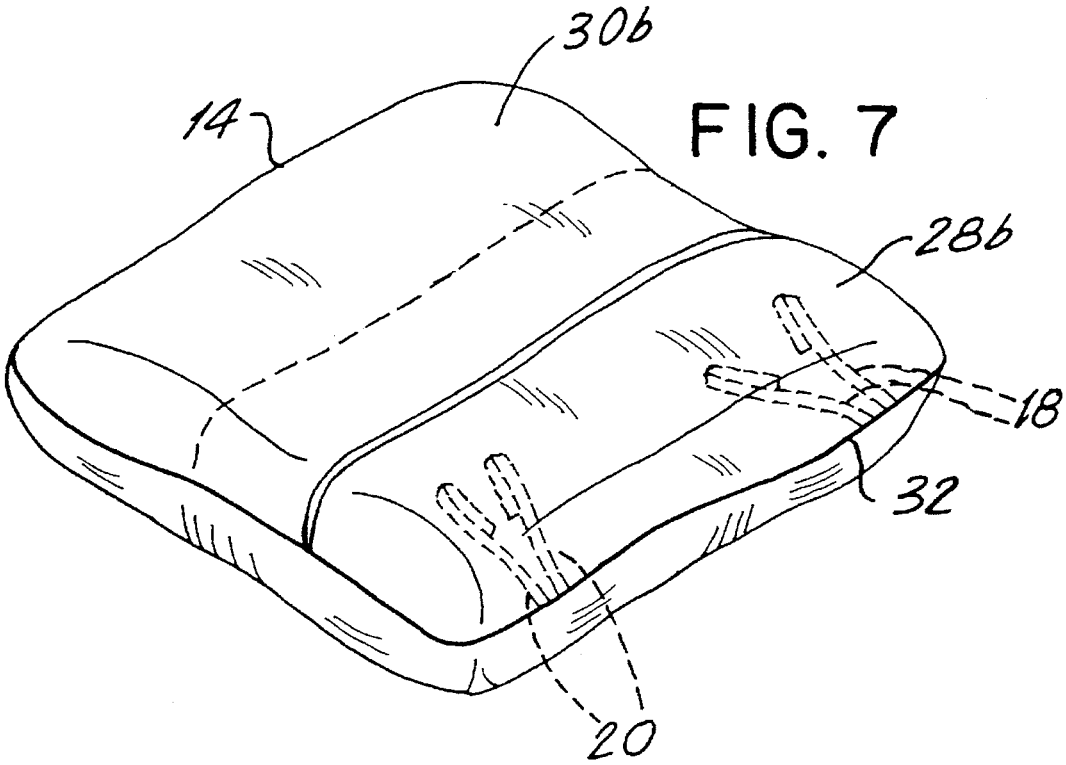
FIG. 7 is an isometric view of the other side of the cushion in the pillow mode.

As seen in FIG. 4, changing the position of flap 28 relative to the enclosure, by moving it from a position adjacent side 12 to a position adjacent side 10, will hide the tie strings 18, 20 and a portion of ruffle 12 within the pocket formed between side 10 and flap 28. Moving the other flap 30 from its position adjacent side 12 to a position adjacent side 10 serves to hide side 10, as well as the remainder of ruffle 22. The cushion, now in the pillow mode, appears as seen in FIGS. 6 and 7. It should be noted that in this mode, side 10 is completely hidden, surfaces 28*b* and 30*b* of the flaps are exposed and therefore coordinate in appearance with side 12 so that the entire cushion is coordinated in appearance.

It should now be apparent that the present invention is a cushion which can be converted between a chair pad and a decorative pillow by simply reversing the relative positions of two fabric flaps. Moreover, the appearance of the cushion in each mode can be made different so as to provide additional versitility.

While only a single preferred embodiment of the invention has been disclosed for purposes of illustration, it is obvious that many variations and modifications could be made thereto. It is intended to cover all of these modifications and variations which fall within the scope of the invention as defined by the following claims:

We claim:

1. A convertible cushion comprising first and second sides having edges joined along a seam to form an enclosure, a flap of flexible material having four edges, said flap extending from one end of said enclosure and being joined to said enclosure seam along three of said edges, a second flap extending from the end of said enclosure opposite to said one end, said first flap and said second flap being adapted to partially overlap when situated adjacent the same side of said enclosure and tie strings extending from said seam along said one end of said enclosure.

2. The cushion of claim 1 wherein said second flap is joined to said enclosure seam along three of its edges.

3. The cushion of claim 1 wherein said first side has a first appearance, said second side has a second appearance and each of said flaps has a first and a second surface, said first surface of each of said flaps having an appearance coordinated with said first appearance and said second surface of each of said flaps having an appearance coordinated with said second appearance.

4. The cushion of claim 1 further comprising a ruffled strip extending from said enclosure seam.

5. The cushion of claim 1 wherein said first and second sides and each of said flaps have a first dimension, said first dimension of said flaps being less than said first dimension of said first and said second sides.

6. The cushion of claim 1 further comprising means for joining said first and said second sides to each other proximate the middle thereof.

7. The cushion of claim 6 wherein said first and second sides are joined proximate the middle thereof in a substantially circular stitch pattern.

8. The cushion of claim 1 wherein each of said sides and each of said flaps has a first dimension and wherein said first dimension of said flaps is less than said first dimension of said sides.

9. A convertible cushion comprising a first and second sides joined along a seam to form an enclosure, first and second flaps extending from said seam at opposite ends of said enclosure, each of said flaps comprising first and second surfaces, each of said surfaces being coordinated in appearance with a different one of said enclosure sides, each of said flaps being affixed to said enclosure seam along three edges, said flaps partially overlapping when adjacent the same side of said enclosure.

10. The cushion of claim 9 further comprising tie strings extending from said enclosure seam at one of said enclosure ends.

11. The cushion of claim 9 wherein said first and second sides and each of said flaps have a first dimension, said first dimension of said flaps being less than said first dimension of said first and said second sides.

12. The cushion of claim 11 wherein said first dimension of said flaps is greater than half but less than the entire first dimension of said first and said second sides.

13. The cushion of claim 9 further comprising means for joining said first and said second sides to each other proximate the middle thereof.

14. The cushion of claim 13 wherein said first and second sides are joined proximate the middle thereof in a substantially circular stitch pattern.

15. A convertible cushion comprising first and second sides having edges joined along a seam to form an enclosure, first and second flaps of flexible material each having four edges, each of said flaps being joined to said enclosure seam along three of its edges, said flaps extending from opposite ends of said enclosure and being adapted to partially overlap when situated adjacent the same sides of the said enclosure.

* * * * *